US009021654B2

(12) United States Patent
Fischer

(10) Patent No.: US 9,021,654 B2
(45) Date of Patent: May 5, 2015

(54) LIQUID ASPIRATOR FOR DRAWING OFF AND SUCKING UP LIQUIDS

(75) Inventor: Klaus-Jurgen Fischer, Holzappel (DE)

(73) Assignee: Leifheit AG, Nassau (DE)

( * ) Notice: Subject to any disclaimer, the term of this patent is extended or adjusted under 35 U.S.C. 154(b) by 0 days.

(21) Appl. No.: 14/122,860

(22) PCT Filed: May 29, 2012

(86) PCT No.: PCT/EP2012/060067

§ 371 (c)(1),
(2), (4) Date: Nov. 27, 2013

(87) PCT Pub. No.: WO2012/163926

PCT Pub. Date: Dec. 6, 2012

(65) Prior Publication Data

US 2014/0109340 A1 Apr. 24, 2014

(30) Foreign Application Priority Data

May 27, 2011 (DE) ..... 10 2011 050 697

(51) Int. Cl.

| | |
|---|---|
| ***A47L 11/34*** | (2006.01) |
| ***A47L 7/00*** | (2006.01) |
| ***A47L 1/05*** | (2006.01) |
| ***A47L 9/06*** | (2006.01) |
| ***A47L 11/40*** | (2006.01) |
| ***A47L 5/24*** | (2006.01) |

(52) U.S. Cl.

CPC ..... *A47L 7/0009* (2013.01); *A47L 1/05* (2013.01); *A47L 7/0004* (2013.01); *A47L 7/0023* (2013.01); *A47L 9/0626* (2013.01); *A47L 11/4016* (2013.01); *A47L 11/4027* (2013.01); *A47L 11/4044* (2013.01); *A47L 5/24* (2013.01)

(58) Field of Classification Search

CPC ..... A47L 11/34; A47L 9/185
USPC ..... 15/320, 347, 353
IPC ..... A47L 11/34
See application file for complete search history.

(56) References Cited

U.S. PATENT DOCUMENTS

| | | | |
|---|---|---|---|
| 4,831,685 | A | 5/1989 | Bosyj et al. |
| 2010/0050368 | A1 | 3/2010 | Curien |

FOREIGN PATENT DOCUMENTS

| | | | |
|---|---|---|---|
| DE | 102008004964 | B3 | 5/2009 |
| DE | 102008004965 | B3 | 5/2009 |
| WO | WO-2010018342 | A2 | 2/2010 |

OTHER PUBLICATIONS

International Search Report and Written Opinion issued in PCT/EP2012/060067, mailed Sep. 3, 2012, with English Translation of Search Report and Written Opinion.

International Preliminary Report on Patentability issued in PCT/EP2012/060067, issue date Dec. 2, 2013.

*Primary Examiner* — David Redding

(74) *Attorney, Agent, or Firm* — Panitch Schwarze Belisario & Nadel LLP

(57) ABSTRACT

Liquid aspirator for drawing off and sucking up liquids, having a drawing-off lip, having a suction device for sucking up the liquid into a separating space in the housing of the liquid aspirator, having an exhaust-air channel, which is subjected to a negative suction pressure and is intended for leading the air out of the separating space, having a separating device, which is arranged in the separating space and separates the liquid from the water, and having a tank for accommodating the liquid. Complex guidance of the liquid/air stream is avoided in that the housing has a hollow chamber which forms the separating space and the tank, and into which the intake channel opens and from which the exhaust-air channel is guided out of the housing; wherein the hollow chamber contains a motor-driven rotor with a rotating impact surface, and the intake channel is designed such that the air/liquid stream is directed for radial direction reversal and acceleration onto the impact surface.

13 Claims, 3 Drawing Sheets

LIQUID ASPIRATOR FOR DRAWING OFF AND SUCKING UP LIQUIDS

CROSS-REFERENCE TO RELATED APPLICATIONS

This application is a National Stage of PCT International Application No. PCT/EP2012/060067, filed on May 29, 2012, and claims priority of German Patent Application No. 10 2011 050 697.7, filed on May 27, 2011. The disclosures of the aforementioned applications are incorporated herein in their entirety by reference.

TECHNICAL FIELD

The invention concerns a liquid vacuuming device for drawing off and sucking up liquids with an extractor device formed by at least one extracting lip for extracting and collecting the liquid in front of at least one vacuum mouth, a vacuuming device which is able to vacuum a flow of air and liquid mixed with the liquid being vacuumed up along a flow pathway from the vacuuming month through an intake channel into a separation space, arranged in a housing of the liquid vacuuming device, an exhaust air valve subjected to a partial vacuum for removing the air from the separation space, a separating device arranged in the separation space, which diverts the incoming air and liquid flow in order to separate the liquid from the air, and with a tank to receive the separated liquid.

STATE OF THE ART

Such a liquid vacuuming device is known from U.S. Pat. No. 4,831,685 A. This device is designed as a wet vacuum cleaner and has a tank in which is provided a flow diversion, which deflects the incoming air and water mixture radially outward, while the intake channel empties as a nozzle into the tank and the incoming mixture of water and air is diverted by a lens-like baffle element, by which it is deflected by at least 90° and flows outwardly. The exhaust air channel likewise empties into the tank and has an opening on the top site, through which the air separated from the water can flow out from the tank or be vacuumed away.

The drawback of this device is that water can drain out from the tank into the exhaust air channel when the device is rotated. Especially when the device is being used to clean a window there is the danger or the need to rotate the device repeatedly or even use it overhead, as is familiar with a manual window squeegee.

Another liquid vacuuming device for extracting and vacuuming of liquids of this kind is known from DE 16 2088 004 964 B and also from DE 10 2068 664 965 B. The known devices, in order to avoid the aforementioned drawback, have a flow channel that leads from a front extraction lip to an air outlet in the rear area of the appliance. Liquid collected by the extraction lip along with surrounding air is vacuumed into the appliance by a vacuum mouth, separated from the air in a separation chamber, and taken to a tank.

For the separating of liquid and air, a separation device is provided in the separation chamber, basically consisting of a profile for diverting the flow of the water and air mixture. This diversion means that the heavier water hits the profile and drips off it into a temporary storage and flows away to a tank-when the device is suitably oriented. The air, on the other hand, cars follow the partial vacuum and is pulled around the profile into the exhaust air channel.

The drawback of the known devices is that the liquid is at first collected in the temporary storages and only then, when the device is held in an upright position with extraction lip pointing upward, are the temporary storages emptied by the liquid flowing away to the tank.

A similar device is shown by US 2010/0050368 A, also having a separate tank, which is protected by check valves against an emptying in an unfavorable position of the device.

PRESENTATION OF THE INVENTION

The problem of the invention is therefore to create a vacuuming device for liquids that can be manufactured with cost economy, has the smallest possible structural volume, and is able to separate air from the liquid taken in and store the liquid in the best possible way.

This problem is solved according to the invention in that the housing has g hollow chamber forming the separation space and the tank, into which the intake channel empties, and in which the separation device is arranged such that the incoming air and liquid flow is diverted into the tank, while the exhaust air is in fluidic connection with the tank, and a flow labyrinth is provided to protect against water spray in front of the entrance to the exhaust air channel.

Now, according to the invention, the liquid is diverted directly into the tank. For this, the tank and the separation space are combined with each other, that is, the intake channel empties into the tank, which forms the separation space by its middle region.

In one preferred embodiment, the intake channel empties into the tank with a free pipe nozzle. The flow of the liquid and air mixture emerging from it then strikes the separating device arranged at the outlet This has the shape of a baffle, which diverts the flow radially outward into the tank. The separating device can be stationary or rotating in configuration.

In the case of a stationary separating device, this can be formed by a disk, which becomes thinner from the inside, to the outside, while the contour against which the flow strikes follows a curved, outwardly directed streamline. That is, the separating device has, for example, the shape of a cone or a valve tappet. Preferably, it diverts the flow with the largest possible deflection angle, yet slight resistance, so as not to impede the flow of air on the one hand, and thus maintain a low energy consumption, and on the other hand to optimize the separating function as much as possible by the changes in direction.

The exhaust air channel in one preferred embodiment also protrudes into the tank with a branch pipe. Alternatively, it can also be flush with the tank wall. In all cases, it should be provided with means to prevent or at least discourage water from getting into the exhaust air channel and being ejected from the device along with the air flow.

Preferably, the means for retaining the water is a flow labyrinth. This together with the separating device forms an effective protection against water getting in, without requiring special resting areas for the flow in addition to the tank. For this, for example, a kind of cap is placed on the pipe branch protruding into the tank, which diverts the air flow twice in its direction of flow. For this, the cap can be closed in front and extend by a wall region along the branch pipe forming the exhaust air channel, while an annular gap or other air passages remain between the branch pipe and the cap through which the air can again flow forward, essentially parallel with the axis of the pipe, until it reaches the front region of the cap on its inside, where the air flow then is diverted again in its direction and can enter the branch pipe.

The annular gap is preferably shaped so that, when the device is held horizontally, water entering the annular gap runs back into the tank once more. For this, for example, the annular gap can be slightly expanded in diameter in the direction of the end of the branch pipe. Additional means can also be provided in the branch pipe to lead out any water that has gotten into the pipe despite all precautions. For example, these could be small drainage holes that take the water back to the tank. An encircling annular gap can also be provided in the exhaust air channel. Any resulting air leak flows can be tolerated, as long as a sufficiently large amount of air is vacuumed up.

Thanks to the invented configuration of the liquid vacuuming device, the mixture of liquid and air is drawn in from the vacuum mouth via the intake channel and diverted to the separating device thanks to the configuration of the intake channel possibly with the aid of an additional flow guiding profile. Alternatively to the stationary baffle, the separating device can also be designed as a rotor, which then acts as a dynamic separating device.

As also in the known liquid vacuuming devices, the device has an extractor lip in the front region and is preferably configured as a single-hand appliance. For this, the housing has a handle by which it is held, so that it can be moved along a pane of glass, for example, like a traditional window squeegee, so that the liquid can be extracted from this pane of glass and at the same time vacuumed up.

Behind the extraction lip, in the region where the liquid collects, the vacuum mouth is provided. This can be designed as a broad slot nozzle. A typical application of the device is a window cleaning appliance, with which water for the cleaning of the window can be extracted and vacuumed up. For this, a sponge can also be arranged next to the vacuum lip, which depending on how the device is oriented can be placed against the window instead of the extraction lip, in order to first wet-clean the window. A supply of liquid can, also be provided for this, by which a cleaning fluid can be pumped manually or by motor in front of the extraction lip or the sponge, or also directly into the sponge.

In one alternative embodiment of the invention, the extraction lip can also be curved or V-shaped, so that the extracted liquid is collected in the middle region, where a vacuum mouth of different shape, such as one acting at specific points, can then vacuum up the liquid. The configuration is especially attractive in devices having a movable extraction lip and-especially those intended for cleaning floors or other horizontal surfaces.

A flow pathway leads from the vacuum mouth via the intake channel to the hollow chamber and from there via the exhaust air channel to a rear vent, from which the air that was separated from the liquid can escape once more. The vacuum action is generated by a rotor (not described more closely here), which produces a partial vacuum that drives the flow, as is also the case in the known liquid vacuuming devices. This rotor is driven by a motor, and the motor is preferably powered by a storage cell or by batteries, in order to assure freedom of movement.

An essential feature of the general notion of the invention is the fact that the flow of liquid and air is diverted directly into the tank, and the water is separated both upon entry and upon exit from the tank. Thanks to this division of the separating means into a front separating device and a rear spray protection, the water can be effectively separated from the air without requiring bulky temporary storage. Instead, the available space can be used directly for the tank volume.

Another preferred embodiment of the invention has a separating device in the form of a moving rotor. Here, the motor for driving the rotor to produce the vacuum pressure also preferably drives the separating device inside the hollow chamber, being designed as a front rotor. For this, the drive motor is connected at first to the impeller wheel of the vacuum subassembly, having a turbine shape, for example, and places it in rotation. As with a traditional vacuum cleaner, this produces the partial vacuum so that air is delivered through the intake channel, the hollow chamber and the exhaust air channel through the housing. This vacuum subassembly is then connected by a further drive shaft to the front rotor, which functions here as a separating device.

An essential feature of this partial aspect of the invention is the fact that the mixture of liquid and air drawn in through the intake channel no longer strikes only a separating baffle, but the motorized rotor arranged in the hollow chamber. At the same time, a region of this hollow chamber forms the tank and also the separating chamber within which the rotor provides for the separating of the liquid from the mixture.

For the separating of the liquid from the incoming flow of liquid and air, the rotor has at least one baffle, against which the flow is directed. This baffle will usually not come directly into communication with the flow, but rather cause, a change in direction of the air flow as an obstacle, while the heavier liquid particles of the flow strike the baffle and because of their inertia are deflected in a different direction than the air. Thus, the sir will essentially follow the partial vacuum and take the shortest flow path.

The liquid, on the other hand, due to its greater inertial forces, will not be deflected so quickly and therefore describes a trajectory with larger radius. On the one hand, this leads to the two media taking different flow pathways, and on the other hand the liquid due to the larger flow radius required will strike against side walls or the rotor itself. The latter, in turn, means that the liquid is separated from the air flow and collects in the annular hollow space surrounding the separating chamber and the exhaust air channel.

Due to the fact that the baffle now lies outside the intake channel, the impeller wheel can have a much larger diameter than the inner diameter of the intake channel. For the baffle to be hit by the flow, flow guiding profiles can be arranged in the intake channel or shortly behind it, which deflect the flow onto the baffle.

Preferably, a flow guiding profile will be used that can be fashioned as a bell or a cone, for example, the tip being arranged in the intake channel and the rearward expanding part deflecting the flow outwardly. This flow then impinges on the annular baffle in the outer region, whereupon the liquid components are then accelerated by the rotating rotor wheel and hurled into the outer region of the hollow chamber. They then drain down from the inner outside wall, the device being normally held in the operating position so that the extraction lip is on top and the separated liquid is located around the exhaust air channel.

The housing can be two-piece, so that either the hollow chamber along with the entire tank can be removed. For this, for example, it can be provided that the hollow chamber is a separate structural part, for example, a cylindrical one, which can be mounted on the exhaust air channel or the air inlet channel, the parting plane of the device being in the region of the hollow chamber. Preferably, the housing is provided with a safety switch, which shuts off the motor when opened or prevents the motor from turning on by interrupting the power supply. Alternatively, the hollow chamber can also be formed by the housing itself, so that the inside of one segment of the housing forms the outside of the hollow chamber. In this case, two partition walls are provided in the housing, one of which has a passageway for the intake channel and the other one a passageway for the exhaust air channel.

In the two-part design of the housing, it can then be opened for emptying or cleaning. For example, the intake channel can be provided on the front housing part, and it is pulled out with the front housing part from the rest of the housing from the hollow chamber. O-rings can seal off the intake channel, so that on the one hand it can be pulled out with the front housing part, but on the other hand it can also be assembled in tight fashion. If the front housing part is removed, the hollow chamber can then be removed as a hollow cylindrical part from the exhaust air channel, which in turn can also be sealed by O-rings.

The aforementioned configuration makes it possible to take apart and clean the housing and, advisedly, also the hollow chamber itself. For this, the hollow chamber can in turn be two-part, so that it can also be broken down into two housing halves. The rotor forming the separating device can likewise be removable in design, so that this also can be easily cleaned. If the cylindrical body forming the hollow space is two-part, the two parts must of course also be joined together by seals, so that liquid can drain from the hollow space when the device is horizontal.

An essential feature is the fact that the liquid situated in the flow of liquid and air is hurled outwardly by the rotor and separated from the air flow, so that liquid can then collect, in the hollow space serving as the tank and be emptied out later on. Since in most instances the liquid vacuum device will be a handheld device, which like a window squeegee will also be used crosswise or even overhead, it is important that the liquid cannot drain back out through the intake channel. For this reason, the intake channel protrudes with a branch pipe into the hollow space, so that even in the overhead position the liquid remains in the tank around this intake pipe and does not drain out from the intake channel.

The same holds when the device is used in the upright position, i.e., when the vacuum lip is arranged at the top. The branch pipe of the drain channel now protrudes into the hollow space, so that once again a hollow space occurs around the pipe of this drain channel, in which liquid can collect without being able to drain down through the exhaust air channel. In summary, therefore, the tank is formed by a region of the hollow chamber into which the intake channel and the exhaust air channel are introduced at top and bottom like branch pipes, so that the ends of the channels protruding like branch pipes make sure in all orientations of the device that the liquid separated from the air flow cannot drain out once more. This function can be strengthened by a cross section of the intake channel and the outlet channel that is slightly expanding in the direction of the inside of the hollow chamber.

There are several basic ways of emptying the device. On the one hand, the hollow space forming the tank can be closed by a plug, which opens up a path to the outside. Thus, an emptying channel is connected to the hollow space, by which the device can be emptied. On the other hand, thanks to the aforementioned cleaning function made possible by the two-part housing and also of the hollow space, an emptying can be done. For this, the device is simply taken apart as described above and the half of the hollow space is emptied once taken apart.

A third possibility of emptying is the intake channel or the exhaust air channel can be shoved into the housing, so that one of the two parts can be pulled out until the branch pipe no longer protrudes into the hollow space. In this way, for example, the device can be placed on its head and the intake channel, which can be firmly joined to the extraction lip, pulled forward. Since the branch pipe protruding into the hollow space is removed by this pulling out, the flow resistance disappears and the liquid located in the hollow space can drain out.

Electrical contacts can make sure that the device can only perform its vacuuming function when the intake channel is in the correct position, i.e., in the inserted position. For this, simple contacts can be provided on the intake channel, which interrupt the intake channel when pulled out by the motorized drive of the vacuum subassembly. In the same way, an emptying function can be provided on the part of the exhaust air channel, in which case the liquid can be emptied through the exhaust air channel being pulled out.

Additional valve means can be provided both on the part of the exhaust air channel and on the part of the intake channel, which can be plain valves that additionally seal off the exhaust air channel or the intake channel when liquid is liable to escape due to an unfavorable rotation of the device.

However, one of the major aspects of the invention is the fact that the intake channel protrudes with its branch pipe into the hollow space from the extraction lip, while at the opposite end the exhaust air channel also protrudes into the hollow space. Between the two branch pipes a gap is formed, in which the rotor is arranged, functioning here as a separating device. The flow of liquid and air strikes this rotor, and a gap is provided between the intake channel and the rotor which is small enough to maintain the vacuum pressure on the one hand, and on the other hand large enough to deliver the flow of liquid and gas through the device without major performance losses.

Thanks to the rotating rotor, the liquid which strikes the rotor due to its inertia or is deflected by the rotor is delivered to the outer region of the hollow space, while the much less inert air is suctioned out from the hollow space by the partial vacuum which is present thanks to the vacuum subassembly at the exhaust air channel. Basically, for example, the branch pipe of the exhaust air channel protruding into the hollow space can have an air inlet opening around its circumference, so that the air can be suctioned out from the hollow space.

Another preferred embodiment on the other hand, has a rotor that is penetrable in the middle and arranged directly in front of the branch pipe of the exhaust air channel protruding into the hollow space. In this embodiment the drive shaft for the rotor extends through the exhaust air channel, so that the rotor and the drive shaft are arranged concentrically to the cylindrical drive channel. In order to ensure the separating function, a flow guiding profile can be provided in the intake channel in this embodiment, which directs the flow from the intake channel outwardly. The rotor has a branch pipe, surrounding the opening for entry into the exhaust air channel, which protrudes into the flow guide profile, fashioned here as a bell or a cone.

Between this branch pipe at the rotor and the flow guide profile there remains a small gap, through which the air after multiple changes of direction can get into the exhaust air channel, while the liquid strikes the baffle of the rotor or is taken into the hollow space by an air flow that is directed outwardly near the baffle, due to the movement of the rotor. Lastly, it is not important whether a portion of the air is delivered along with the liquid into the hollow space, as long as the geometry of the exhaust air channel or the air inlet into the exhaust air channel makes sure that air drawn in through the intake channel is again drawn out through the exhaust air channel without the liquid also drawn in.

Preferably, the window cleaning device can also be provided with an on and off switch function, which either shuts off the motorized drive of the vacuum subassembly entirely or reduces the power in order to avoid overly long restart times. In one possible embodiment, the on and off switch is design so that a pressure on the extraction lip turns on the device of increases the motor power. Relaxing the pressure can then shut off the device or reduce the power.

Alternatively, a timer may be provided, which switches off or reduces suction performance after a certain predetermined period of time. Finally, an orientation switch is a possible alternative or complement, which would switch off or reduce the performance of the suction unit when the unit is tilted out of its upright position in which the leveling blade is oriented upward, or when it is swung. Since suction may be desired also or specifically during lateral motions with a sideward-oriented leveling blade, the orientation switch may be embodied so that it is activated only when the leveling blade points downward. A delay switch may delay the off-switching function, so that a brief tilt does not yet affect the engine function.

For the implementation of the pressure switch, the leveling blade may be positioned on the casing in a manner that allows it to move lightly against the force of a return spring or the elasticity of the component itself, whereby the swiveling bearing comprises a sensor capable of registering a slight backward motion of the leveling blade and convert it into a switch-on impulse. Similarly to a stand-by switch, this may be implemented by way of a secondary switch, so that an initial pressure on the leveling blade activates the tool in its entirety.

A further embodiment of the invention features a leveling blade which is embodied together with the suction nozzle as a separate component which is inserted into the device, whereby the suction nozzle is connected by way of a plug and seal pipe connection with the intake duct. This embodiment has the advantage that the functional unit formed by the leveling blade and the suction nozzle can be detached in its entirety, and connected with the device by way of a tube. This makes it possible to attach this functional unit to a shaft or to a tube in order to obtain a light abductor with suction functionality, whereas the rest of the device is either attached to a carrying strap worn by the operator, or is positioned independently on the ground. In this case, the shaft features a suction duct or a suction tube, and may be connected on one end with the device, and on the other end with the unit comprising the leveling blade and the suction nozzle, so that water may be taken in by the suction nozzle through the suction duct or the suction tube.

Alternatively, or in addition, only the leveling blade is embodied as a detachable unit. This allows for using the leveling blade independently of the device, when the suction function is not needed.

Finally, the casing, in particular the backside opposite the suction nozzle, may feature a slot for receiving a shaft. Preferentially, this would be a universal slot for receiving shafts of household tools which are common in households anyway. In this case, the shaft, which may also be embodied as a telescopic shaft, can be easily attached to the casing, in this manner too, the reach of the operator can easily and simply be extended.

The leveling blade, and optionally, the suction nozzle too, may be attached to the casing in a rotating or swiveling manner, which may, for instance, be accomplished by way of a sealing ball and socket joint, which is part of the connection between the casing and the unit comprising the leveling blade and the suction nozzle. This ball and socket joint may be embodied in such a manner that the intake duct leads through the joint. Alternatively, the intake duct may also be embodied in the form of a tube leading past the joint alongside it.

Additional characteristics and advantages of the invention follow from the subsidiary claims and from the following description of a preferential sample embodiment on the basis of the drawings.

BEST WAY TO CARRY OUT THE INVENTION

Figure 1:
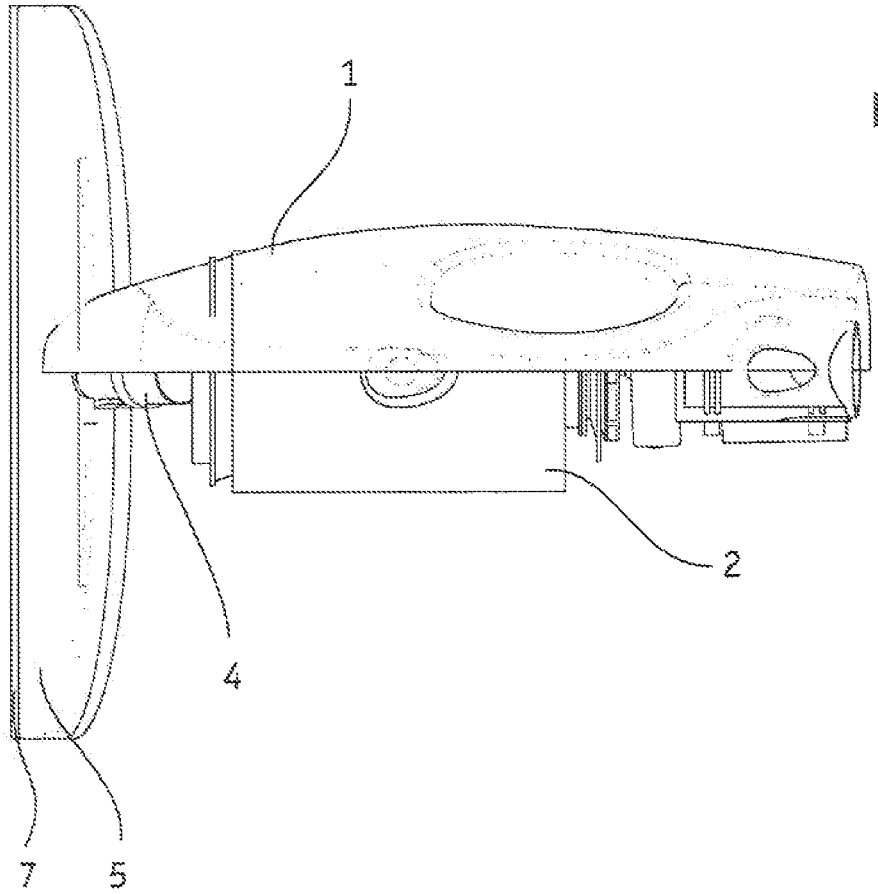
FIG. 1 shows a top view of a suction device for liquid intake according to the invention, partially in cross section.

FIG. 1 shows a suction device for liquid intake according to the invention. In the image, the top part is shown uncut, whereas the lower part is shown in cross section, whereby for the purpose of clearness, the cut edges of casing 1 are not shown.

In its front part, the instrument features a leveling blade 7, capable of removing the liquid from a surface. The classical application of this device is the removal of water from a window surface. Behind the leveling blade 7 there is a suction nozzle 5, which is embodied here as a broad nozzle of which the width essentially complies with the width of the leveling blade 7. Via an intake duct 4, the liquid-air mixture is sucked into a hollow chamber 2, the hollow chamber 2 serving as a separation chamber with a separation device, capable of separating the liquid from the air flow.

Figure 2:
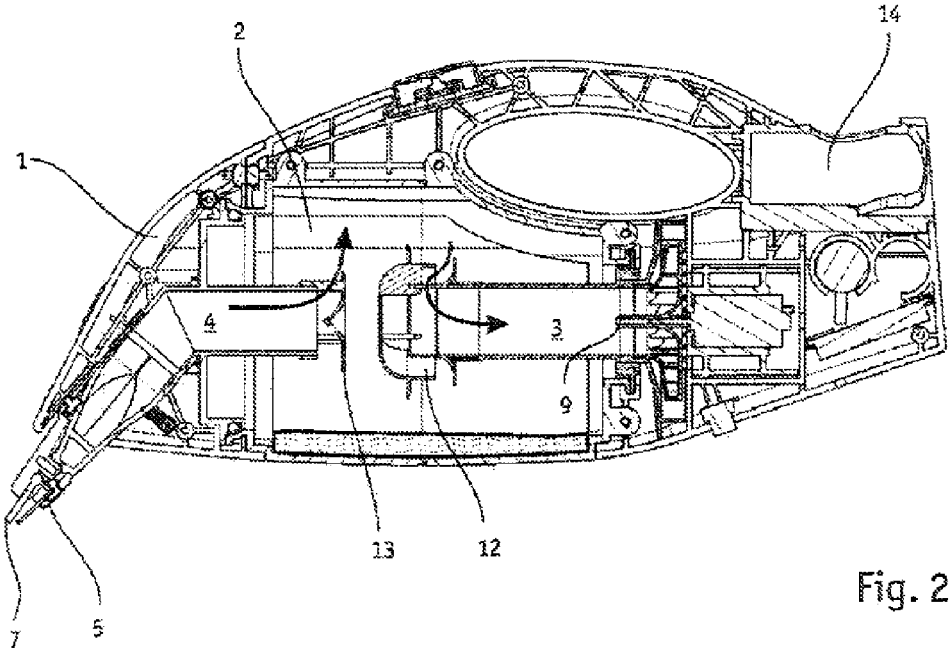
FIG. 2 shows a side view in cross section of the suction device for liquid intake shown in FIG. 1, in a first embodiment of the separation device.
Figure 3:
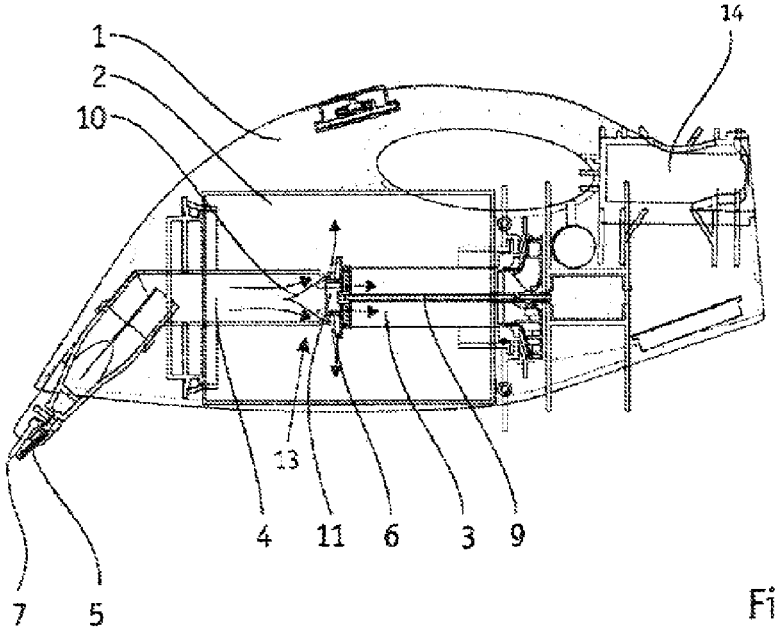
FIG. 3 shows a side view in cross section of the suction device for liquid intake shown in FIG. 1 in a second embodiment of the separation device.

The rest of the functionality of the device is explained in greater detail by way of a cross section in FIGS. 2 and 3, as well as the detailed view in FIG. 3:

The hollow chamber 2 is supplied in the casing 1 as a central, tank-like component. This hollow chamber 2 combines various functions of the suction device for liquid intake. On the one hand it is the tank in which the separated liquid can be collected after it is separated out of the liquid-air mixture. On the other hand, the separation chamber is integrated within it, in which the separation between the air and the liquid takes place. Finally the hollow chamber 2 forms a protection that prevents the separated liquid from flowing out again.

The air duct 3 as well as the intake duct 4, each of them with a nozzle, stick into the hollow chamber 2. These two ducts are positioned concentrically with respect to each other, and approach each other, whereby the separation device 13 is positioned between the ends of the two ducts.

FIG. 2 shows a first embodiment of the invention with a rigid separation device 13, embodied here as a stator, and which channels the flow radially outward into the tank.

The rear part of the tank is where air duct 3 protrudes into the tank. To avoid spray water from entering the air duct 3, the nozzle-shaped air duct embodiment 3 features a flow labyrinth 12, which, as can be seen from the arrow that schematically indicates the air flow, forces a double direction switch on the flow, thereby separating any remaining water from the air, which stays behind in the tank.

In the embodiment shown in FIG. 3, in the gap between duct 3 and intake duct 4 remains, in which the rotor 6 is located. This rotor 6, in turn, is driven by way of a drive shaft 9, whereby the drive shaft 9 is positioned concentrically with respect to air duct 3. The rotor 6 reaches with its impact surfaces laterally past the air duct 3 into the hollow chamber 2.

In its final part, the air duct 3 features a flow guiding profile 10, which takes the shape here of a hollow conic section. This conic section guides the sucked-in mixture of water and air outward through intake duct 4, so that it reaches the outer reaches of the rotor 6, which forms the impact surface here. The result is that the sucked-in liquid and air flow is accelerated radially as well as in the circumferential direction of the rotor 6, whereby the slower liquid enters into a different trajectory than the lighter air.

As can be seen on FIG. 3, the motor and the suction unit are located in the rear part of the casing 1, where the power supply is also located, in the form of a battery. This implies that the center of gravity of the instrument is in the rear of it, and that it can therefore be very easily moved in upright position along a window or another surface.

The front part is where the leveling blade 7 is positioned, behind which the suction nozzle 5 is located. From here, the flow duct leads through the intake duct 4 into the hollow chamber 2.

Figure 4:
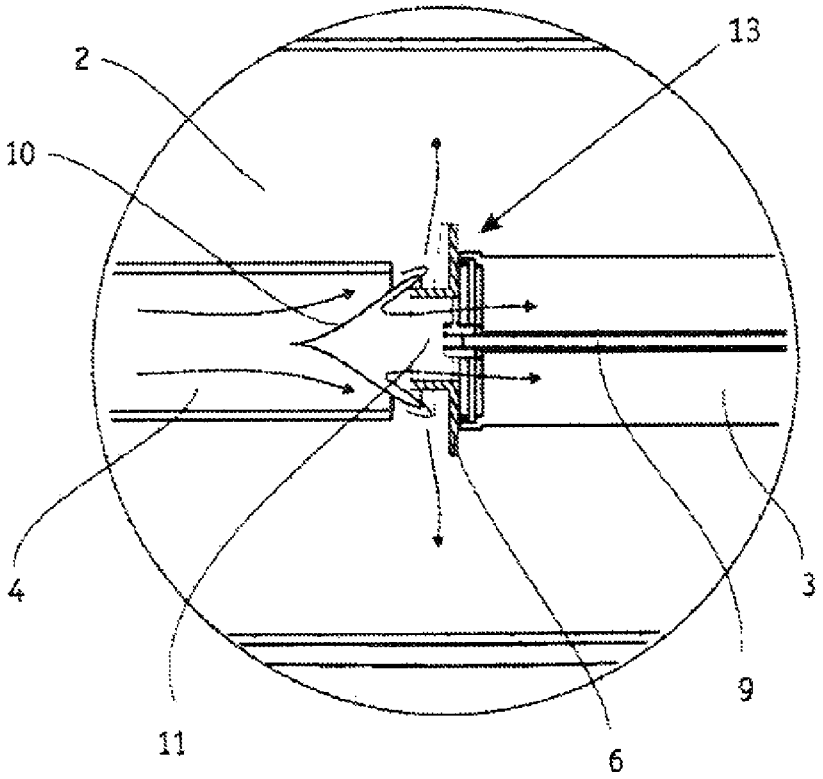
FIG. 4 shows the reach of the rotors of the suction device for liquid intake shown in FIG. 3.

FIG. 4 shows the area of the rotors 6 inside the hollow chamber 2 again, in an enlarged view. As shown, the rotor 6 reaches into the flow guiding profile 10. For these purposes, it features a ring-shaped nozzle, protruding forward from the rotor 6 in the direction of the intake duct 4.

Between the area of the rotor 6 and the flow guiding profile 10 are some small remaining gaps, so that the air that is meant to be sucked out forms a labyrinth seal, which follows the internal arrows, first along the outside of the flow guiding profile 10 outward, then by way of a tight curve inward into the inside of the flow guiding profile 10, and from there through the rotor 6, which is hollow on the inside, into the air duct 3. The slower liquid is unable to flow in such a tight trajectory, and will therefore follow the outer arrows, and move outward in a radial and circumferential direction of the rotor. This means that the liquid is collected in the hollow chamber 2, in particular along its interior walls, and when the instrument is in upright position, in the lower part of the hollow chamber 2, which then serves as a tank.

The displayed embodiment of the liquid collection device is only one way conceivable to use the basic principle of the invention. An essential part of the invention is the fact that a separate separation chamber is no longer envisioned, and that the liquid and air flow is directed directly to a rotor 6, which through its rotation uses the different dynamic inertias of air and liquid in order to separate the two flows. As displayed, the rotor 6 is further capable of being driven by the air duet 3 by way of a drive shaft 9, whereby it is obviously also possible, alternatively, that the rotor 6 is driven by a separate drive.

In the hollow chamber 2, a liquid level sensor can be envisioned, which may be formed by an electrical contact, and which switches off the motor when a certain liquid level has been reached, beyond which it is no longer guaranteed that liquid can escape via air duct 3 or via intake duct 4. The battery, located, in the rear area of the device, is preferably linked with the casing 1 by way of a detachable connection, so that it can be removed for the purpose of recharging, for instance, and be connected to a power supply. The casing 1 may further feature in its rear area a place to attach a shaft, which would allow the use of the instrument for higher surfaces, An additional preferential embodiment features a detachable rubber blade by way of a leveling blade 7, which might be connected to a holding shaft protruding into the casing 1 in such a manner that if is positioned in front of the suction nozzle 5, as shown. The holding shaft may then be embodied as a suction pipe, and reach into the casing 1 in a detachable manner, which has the advantage for the user in that he can remove the leveling blade 7 for smaller difficult tasks that do not require suction, and use it as a small removal tool.

REFERENCE LIST

1 casing
2 hollow chamber
3 air duct
4 intake duct
5 suction nozzle
6 rotor
7 leveling blade
9 drive shaft
10 flow guiding profile
11 suction support
12 flow labyrinth
13 separation device
14 connector socket for attaching a shaft

The invention claimed is:

1. A suction device for drawing off and sucking up liquids, including:

featuring a casing;

a removal device, formed at least of a suction nozzle and a leveling blade for the removal and collection of the liquid before at least the suction nozzle, wherein the leveling blade is connected to the casing in a movable manner, by moving bearings that include a switch, the moving of which can switch the leveling blade between an OFF and an ON setting, and whereby a motor drive is configured to be switched on and off by the switch, a hollow chamber located in the casing;

a suction device configured to guide an air and liquid flow that includes the liquid intended for removal via a flow trajectory from the suction nozzle through an intake duct into the hollow chamber;

a negatively pressured exhaust air duct configured to guide air out of the hollow chamber;

a separation device located inside the hollow chamber, which, in order to separate the liquid from the air, is configured to divert the air and liquid flow;

wherein the hollow chamber is configured to act as a separation chamber and as a tank configured to collect the separated liquid, into which the intake duct opens, and in which the separation device is arranged in such a way that the sucked-in air and liquid flow is diverted into the hollow chamber, and the air duct is in a flow connection with the hollow chamber, wherein the separation device is formed by a flow guide on an air intake side in the form of a stator or a rotor configured to be driven by the motor drive, which is positioned in the hollow chamber on the intake duct or inside the hollow chamber before the intake of the air and liquid flow, and which is configured to radially guide the sucked-in air and liquid flow outwards into the hollow chamber, and further including a flow labyrinth, positioned before an intake into the air duct and configured to hold back spray water from entering the air duct.

2. The suction device according to claim 1, wherein the flow labyrinth is formed by a cap which covers a nozzle-like air intake of the air duct, wherein the cap extends beyond the air duct, and wherein between the cap and an outer wall of the air duct there will at least be a gap, an annular gap or a channel-like air opening to permit air to be sucked past the outer wall of the air duct between the air duct and the inside of the cap, and then, after a direction switch, out of the hollow chamber by way of the air duct.

3. The suction device according to claim 2, wherein the air duct features a radial and outwardly protruding flow barrier, which is wall-shaped and fully envelops the air duct, wherein the cap extends past the flow barrier, without affecting an air intake opening for suction of air from the hollow chamber into the flow labyrinth, to such an extent that in any orientation of the suction device for liquid intake, any water inside the hollow chamber is permitted to flow out laterally either at the cap or at the flow barrier, and is prevented from entering into the air duct.

4. The suction device according to claim 1, wherein the flow labyrinth comprises a motor-driven rotor with a rotating cap.

5. The suction device according to claim 4, further including a motor configured to drive the suction unit and for generating negative pressure, wherein the rotor is configured to be driven by the same motor that powers the suction unit, and wherein the motor is connected by way of a drive shaft with a rotation axis of the rotor.

6. The suction device according to claim 5, wherein the rotor is the suction unit generating the negative pressure.

7. The suction device according to claim 1, wherein the intake duct and/or the air duct features a nozzle protruding into the hollow chamber.

8. The suction device according to claim 1, further comprising a flow guiding profile located inside the intake duct which is configured to direct the air and liquid flow towards the separation device.

9. The suction device according to claim 8, wherein the flow guiding profile is embodied in such a manner that a circular air and liquid flow is generated.

10. The suction device according to claim 9, wherein the flow guiding profile is embodied in a manner featuring a bell-shaped cross section in a direction of the rotor whereby the circular air and liquid flow is guided past the outside of the flow guiding profile, towards an impact surface, wherein the rotor reaches with a suction support into a hollow space of the flow guiding profiles, wherein the air duct is embodied and positioned in such a manner that air outflow, which was separated from the liquid, flows through an annular gap between the suction support and inside surfaces of the flow guiding profiles.

11. The suction device according to claim 1, wherein the leveling blade is connected to the casing in a detachable manner by way of a connecting plug, detachably connected with the casing, whereby, when the leveling blade is detached, the connecting plug can be used as a manual abductor with the leveling blade.

12. The suction device according to claim 1, wherein a back side of the casing, which faces the suction nozzle, comprises a connection socket for a shaft, into which a shaft or a telescopic shaft can be inserted, and through which the shaft can be attached by way of a friction lock or a form lock.

13. The suction device according to claim 1, wherein the suction nozzle is configured to be able to swivel with respect to the casing.

* * * * *